US010260733B2

(12) United States Patent
Parsons

(10) Patent No.: US 10,260,733 B2
(45) Date of Patent: Apr. 16, 2019

(54) HIGH POWER FLASHLIGHT WITH POLYMER SHELL

(71) Applicant: Armament Systems and Procedures, Inc., Appleton, WI (US)

(72) Inventor: Kevin Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 77 days.

(21) Appl. No.: 15/648,829

(22) Filed: Jul. 13, 2017

(65) Prior Publication Data

US 2019/0017694 A1 Jan. 17, 2019

(51) Int. Cl.

| | |
|---|---|
| ***F21V 29/89*** | (2015.01) |
| ***F21V 7/22*** | (2018.01) |
| ***F21L 4/08*** | (2006.01) |
| ***F21V 29/70*** | (2015.01) |
| ***F21V 17/12*** | (2006.01) |
| ***F21V 23/00*** | (2015.01) |
| ***F21V 23/04*** | (2006.01) |
| ***F21V 21/40*** | (2006.01) |
| *F21Y 115/10* | (2016.01) |

(52) U.S. Cl.

CPC ..... *F21V 29/89* (2015.01); *F21L 4/08* (2013.01); *F21V 7/22* (2013.01); *F21V 17/12* (2013.01); *F21V 21/406* (2013.01); *F21V 23/003* (2013.01); *F21V 23/0421* (2013.01); *F21V 29/70* (2015.01); *F21Y 2115/10* (2016.08)

(58) Field of Classification Search

CPC .... F21V 29/70; F21V 21/406; F21V 23/0421; F21L 4/08

USPC ..... 362/145–208

See application file for complete search history.

(56) References Cited

U.S. PATENT DOCUMENTS

| | | | | |
|---|---|---|---|---|
| 7,153,004 | B2 | 12/2006 | Galli | |
| 8,919,988 | B2 * | 12/2014 | Unger | F21L 14/02 362/157 |
| 9,453,625 | B2 | 9/2016 | Maglica | |
| 2005/0007772 | A1 * | 1/2005 | Yen | F21L 4/027 362/206 |
| 2011/0085324 | A1 * | 4/2011 | Liu | F21L 4/005 362/190 |
| 2013/0182419 | A1 * | 7/2013 | Worman | F21V 15/01 362/183 |
| 2013/0343042 | A1 * | 12/2013 | Windom | F21L 4/08 362/183 |
| 2014/0140048 | A1 * | 5/2014 | Miller | H02J 7/0027 362/183 |
| 2014/0240967 | A1 * | 8/2014 | Sharrah | F21L 4/08 362/183 |
| 2015/0036330 | A1 * | 2/2015 | Economos | F21L 4/08 362/183 |
| 2016/0153646 | A1 * | 6/2016 | Maglica | F21V 23/0428 362/187 |

* cited by examiner

*Primary Examiner* — Laura K Tso

(74) *Attorney, Agent, or Firm* — Hahn Loeser & Parks LLP

(57) ABSTRACT

A high power flashlight with a polymer shell.

13 Claims, 2 Drawing Sheets

HIGH POWER FLASHLIGHT WITH POLYMER SHELL

BACKGROUND

High power light emitting diode ("LED") flashlights are known to be useful and dependable tools. The LED lamps may produce hundreds of lumens of light, are shock resistant, and have lifespans measured in tens of thousands of hours. One drawback of high power LED lamps, however, is the considerable heat that they produce. Proper thermal management of LEDs is necessary to avoid unduly shortening the lifespan of LEDs due to excessive temperatures. Accordingly, it is common in known LED flashlights to provide a metal alloy bezel and/or housing to enclose the LED lamp and reflector, and to thermally couple the LED lamp to the metal alloy bezel and/or housing to dissipate the heat. In such known flashlights, the bezel of the flashlight may be a separate component that is joined to a housing of the flashlight, often by threaded engagement. Alloys of aluminum and other metals are often used for their high thermal conductivity, corrosion resistance and strength.

Aluminum alloy components have certain disadvantages. For example, colors cannot be molded into an aluminum alloy component. Only a very limited range of colors may be hard coat anodized onto the surface. Paint and other coatings have a wide gamut of colors and may be applied to metal alloy surfaces, but paints and other coatings are subject to wear, fading, scratching and other damage. Additionally, while some alloys are relatively lightweight compared to other metals, they are heavy relative to other materials, such as high strength thermoplastics and polymers.

High strength polymer components have certain advantages over metal alloy components. Polymer components are lighter in weight than their metal alloy counterparts. Also, a wide range of colors and patterns may be molded into polymer components, such as high visibility colors, camouflage patterns, and the like. However, polymers and plastics have relatively low thermal conductivity, and are unsuitable for thermal management applications.

SUMMARY

A flashlight is disclosed comprising a housing, a bezel, and a universal serial bus ("USB") connector through which power can be supplied to recharge a battery inserted into a battery chamber in the housing if the battery is a rechargeable battery. The housing comprises a polymer shell and a metal core disposed substantially within the polymer shell. The bezel comprises an LED lamp, and a metal reflector disposed within a polymer shell. In some embodiments, the polymer may comprise polyoxymethylene. The metal core and the metal reflector may comprise aluminum. A heat bridge is thermally coupled to the LED lamp, the metal reflector, and the metal core, thereby conducting heat away from the LED lamp without requiring a metal alloy outer housing or bezel, and diminishing the deteriorating effects of high temperatures on a polymer housing or bezel.

In some embodiments, the flashlight comprises an LED driver that is electrically connected to the LED lamp. The LED driver also may be thermally coupled to the metal core. An end cap may be provided in threaded engagement with the housing. The metal core may partially extend longitudinally from the polymer shell portion of the housing and may provide a threaded portion extending beyond the polymer shell for attachment of the end cap.

BRIEF DESCRIPTION OF THE DRAWINGS

The following drawings illustrate the concepts of the present invention. Illustrations of an exemplary device are not necessarily drawn to scale.

DETAILED DESCRIPTION

Figure 1:
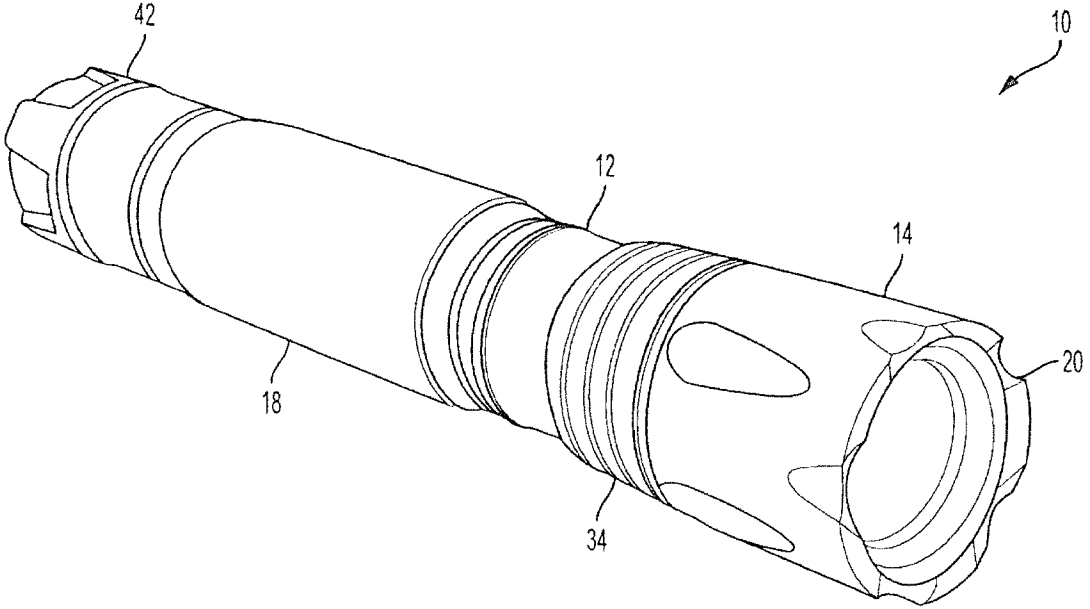
FIG. 1 is a perspective view of an embodiment of a high power with a polymer shell.
Figure 2:
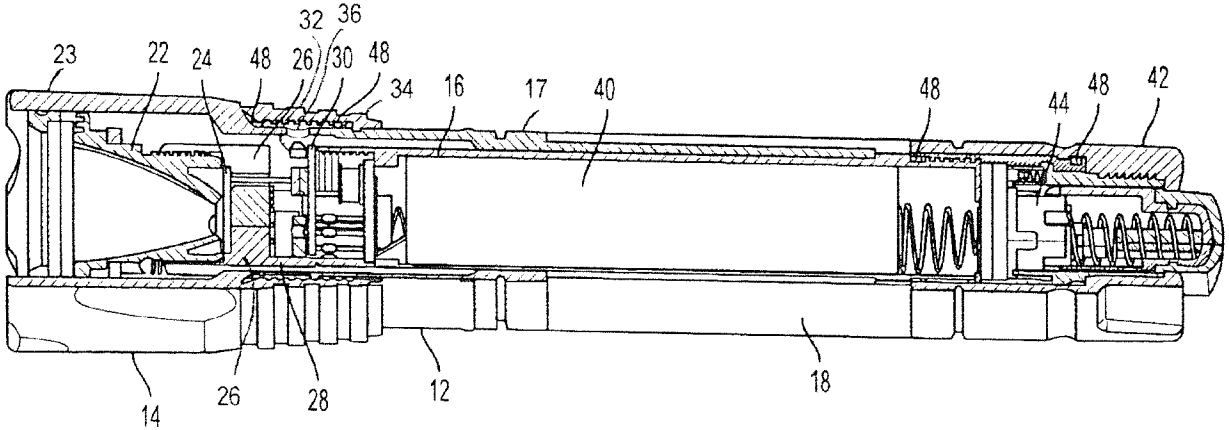
FIG. 2 is a cut-away view of the embodiment illustrated in in FIG. 1.

While the embodiments described can take many different forms, specific embodiments illustrated in the drawings will be described with the understanding that the present disclosure is to be considered an exemplification of the principles of the invention, and is not intended to limit the invention to a specific embodiment illustrated.

A high power LED flashlight is described that avoids the problems of known LED flashlights. In one example, a flashlight 10 comprises a housing 12, a bezel 14, a battery 40, and a heat bridge 28. The housing 12 comprises a polymer shell 17 and a metal core 16 disposed substantially within the polymer shell 17. The bezel comprises a polymer shell 23, and a light emitting diode (LED) lamp assembly 24 and a metal reflector 22 disposed within the polymer shell 23 of the bezel. The lamp assembly 24 comprises at least one LED lamp. The heat bridge 28 is thermally coupled to the LED lamp, the metal reflector 22, and the metal core 16. In some embodiments, the heat bridge 28 comprises a heat sink 26. The heat bridge 28 conducts heat away from the LED lamp without requiring an outer metal housing or bezel, and diminishes deteriorating effects of high temperatures on the polymer shells 17 and 23 of the housing and the bezel, respectively. In some examples, the metal core 16 and/or the metal reflector 22 comprise aluminum. In some examples, the heat sink 26 comprises copper.

In one example, the housing 12 and the bezel 14 comprise molded polymer shells 17 and 23, respectively. One suitable material for the polymer shells 17 and 23 is polyoxymethylene, which is sold under the brand name Delrin by DuPont. A metal core 16 is inserted or molded into the shells 17 and 23. Metal core 16 is thermally and electrically conductive, and provides additional structural rigidity. In some examples, the metal core 16 is machined aluminum. In some examples, the housing 12 and the bezel 14 comprise a unitary molded body. In other examples, the housing 12 and the bezel 14 may be molded separately and then joined together.

In some examples, a lens 20, the metal reflector 22, and the LED lamp assembly 24 are located in the bezel 14. The metal reflector 22 may have a parabolic interior shape with an aperture for the LED lamp. The LED lamp may comprise a Cree XPG lamp. The LED lamp assembly 24 is mounted on the heat sink 26 and is oriented such that the LED lamp is positioned through the aperture and inside a cavity of the metal reflector 22. The cavity of the metal reflector 22 is shaped and polished to provide a focused beam when the LED lamp is illuminated. The metal reflector 22 is formed from a thermally conductive material, such as polished aluminum. The LED lamp is thermally coupled to the metal reflector 22 via heat sink 26. The heat sink 26 also is coupled to the metal core 16 by a portion of the thermally conductive heat bridge 28. Thus, the structure of the disclosed flashlight 10 conducts heat away from the LED lamp 24 in both forward and rearward directions, without the need for an outer metal housing or bezel. This results in a substantial weight savings.

A LED driver 30 is coupled to the LED lamp. The LED driver 30 comprises one or more printed circuit boards having control electronics to supply current to the LED lamp assembly 24. LED driver 30 may provide constant current and voltage to the LED lamp. The LED driver 30 also may provide pulse width modulated (PWM) voltage and current to the LED lamp to control brightness and/or power dissipation. In one example, LED driver 30 provides current and voltage to the LED lamp such that it produces 440 lumens of light in one mode, and 15 lumens of light in another alternate mode. In some examples, an output of the LED lamp is at least about 500 lumens. The LED driver 30 also may also be thermally coupled to the metal core 16.

In some examples, the flashlight 10 comprises a USB connector 32 and battery charging circuitry. The USB connector 32 preferably comprises a micro USB connector and may be accessed through an aperture 36 in the housing 12. Protective ring 34 and housing 12 may be in threaded engagement with each other such that the aperture 36 may be selectively covered and revealed by rotating protective ring 34 with respect to housing 12. O-ring seals 48 may provide protection from environmental damage.

The housing 12 is dimensioned to receive one or more batteries 40. Preferably, the battery 40 is a rechargeable lithium ion battery, such as a 2200 mAh 18650-type battery. In one example, the battery 40 is rechargeable and has both plus and minus electrical terminals at first end of the battery 40 in electrical contact with the LED driver 30, and a minus terminal at second opposite end of the battery 40 in electrical contact with a switch 44. This allows charging of the battery 40 at the top terminals of the first end of the battery 40 even when the switch 44 is open. When the switch 44 is in a closed position, an electrical connection to the LED driver 30 is made through the metal core 16. Thus, metal core 16 provides thermal, electrical, and structural functionality. Optionally, housing 12 is dimensioned to receive two non-rechargeable CR123A cells in series. Since the CR123A cells do not have a minus terminal at the first end, they are unaffected by the charging circuit, but still electrically connect with the switch 44.

In some examples, the metal core 16 is threaded on an end of the housing 12 opposite an end where the LED driver 30 is disposed. A removable end cap 42 may be attached to the housing 12, such as to a threaded portion of the metal core 16 that extends beyond the polymer shell 23. Removing the end cap 42 provides access to a battery chamber, and allows replacement of the battery 40. End cap 42 preferably includes the switch 44. The switch 44 may include positions for intermittent activation, persistent activation, and for preventing activation of the LED lamp. However, any suitable switch may be used. The switch 44 is electrically connected to the LED driver 30.

The body may be molded in any number of colors as may be desired, including, high-visibility colors and camouflage colors. Such molded-in colors are far more resistant to damage than painted coatings. In some embodiments, the flashlight 10 further comprises a foam grip 18 surrounding at least a portion of the polymer shell 17 of the housing 12. The foam provides thermal insulation from hot and cold for user comfort.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

What is claimed is:

1. A flashlight, comprising:

a housing comprising a polymer shell and a metal core disposed substantially within the polymer shell, the housing further comprising a battery chamber;

a bezel comprising a polymer shell, and a light emitting diode (LED) lamp and a metal reflector disposed within the polymer shell of the bezel;

a universal serial bus (USB) connector;

battery charging circuitry configured so that power, supplied through the USB connector, can recharge a battery inserted into the battery chamber if the battery is rechargeable; and a heat bridge that is thermally coupled to the LED lamp, the metal reflector, and the metal core, the heat bridge conducting heat away from the LED lamp without requiring an outer metal housing or bezel, and diminishing deteriorating effects of high temperatures on the polymer shells of the housing and the bezel.

2. The flashlight of claim 1, further comprising an end cap in threaded engagement with the housing.

3. The flashlight of claim 2, wherein the metal core provides a threaded portion extending beyond the polymer shell of the housing for attachment of the end cap; and the battery chamber is dimensioned to receive the battery when the end cap is disengaged from the housing.

4. The flashlight of claim 1, further comprising:

an LED driver that is electrically connected to the LED lamp; and a switch;

wherein, if the battery is inserted into the battery chamber, the battery is electrically connected through the switch to power the LED driver.

5. The flashlight of claim 4, wherein the battery comprises a rechargeable lithium ion battery.

6. The flashlight of claim 4, wherein the battery comprises a non-rechargeable battery.

7. The flashlight of claim 4, wherein the battery charging circuitry is physically arranged so that, if a non-rechargeable battery is inserted into the battery chamber, a charging voltage powered from the USB connector cannot be applied across the non-rechargeable battery.

8. The flashlight of claim 1, wherein the polymer shells of the housing and of the bezel comprise polyoxymethylene.

9. The flashlight of claim 1, wherein the metal reflector comprises aluminum.

10. The flashlight of claim 1, wherein the metal core comprises aluminum.

11. The flashlight of claim 1, wherein the heat bridge comprises copper.

12. The flashlight of claim 1, wherein the output of the LED is at least about 500 lumens.

13. The flashlight of claim 1, further comprising a foam grip surrounding at least a portion of the polymer shell of the housing.

* * * * *